US006431997B1

(12) United States Patent
Rohrer

(10) Patent No.: US 6,431,997 B1
(45) **Date of Patent: *Aug. 13, 2002**

(54) GOLF CLUBHEADS CORRECTING DISTANCE LOSS DUE TO MISHITS

(76) Inventor: John W. Rohrer, 49 Long Cove Rd., York, ME (US) 03939

( * ) Notice: Subject to any disclaimer, the term of this patent is extended or adjusted under 35 U.S.C. 154(b) by 0 days.

This patent is subject to a terminal disclaimer.

(21) Appl. No.: 09/333,449

(22) Filed: Jun. 15, 1999

(51) Int. Cl.[7] ..... A63B 53/04; A63B 53/06; A63B 53/08

(52) U.S. Cl. ..... 473/324; 473/329; 473/332; 473/340

(58) Field of Search ..... 473/329, 332, 473/340, 342, 347, 326

(56) References Cited

U.S. PATENT DOCUMENTS 5,000,455 A * 3/1991 Beilfuss, Sr. ..... 273/175
5,083,778 A * 1/1992 Douglass ..... 273/78
5,529,543 A * 6/1996 Beaumont, Sr. ..... 473/290
5,766,093 A * 6/1998 Rohrer ..... 473/329
5,944,614 A * 8/1999 Yoon ..... 473/224

* cited by examiner

*Primary Examiner*—Paul T. Sewell
*Assistant Examiner*—Sneh Varma
(74) *Attorney, Agent, or Firm*—Kevin M. Farrell

(57) ABSTRACT

Golf shots lose both distance and directional accuracy when the ball is struck at a clubface location not aligned with (i.e. directly in front of) the clubhead center of gravity (a "mishit"). High moment of inertia clubhead designs (i.e., extreme toe heel weighting) only partially reduce mishit distance loss and are limited by practical clubhead size and weight. The subject invention reduces, or totally eliminates mishit distance loss regardless of clubhead moment of inertia via designs which absorb more ball impact energy for on-center hits versus mishits thus equalizing distance. The invention allows for the use of integral or attached metal or plastic faceplates without impeding the function of such variable energy absorbing mishit corrective devices, thereby greatly improving clubhead durability, feel, and practicality, especially for irons and putters.

10 Claims, 2 Drawing Sheets

GOLF CLUBHEADS CORRECTING DISTANCE LOSS DUE TO MISHITS

BACKGROUND OF THE INVENTION

The present invention relates to all golf clubheads, but more particularly irons and putters, where consistent distance and direction are more desirable than the maximum distance usually sought with low lofted woods and metalwoods. The present invention relates specifically to improved clubhead and clubhead insert designs, which substantially reduce or totally eliminate mishit distance loss.

Golf shots lose both distance and directional accuracy when a golf ball is struck at a clubface location not aligned with (i.e. directly in front of) the clubhead center of gravity. Misdirection is primarily caused by the angular rotation of the clubhead upon impact with a ball not aligned with the "clubhead center of gravity" (which includes the effect of clubshaft weight). Mishit distance loss is caused by both the misdirection [one minus the cosign of angular difference between initial line and post impact deflected line] and clubhead energy lost to clubhead rotation rather than transferred to the ball at impact.

These effects have long been postulated and intuitively observed by skilled golfers and club designers. Only in the past decade, however, have these effects been quantitively and empirically measured using ball striking robots featured in club and ball test reports in popular golf literature. Irons and woods (including metalwoods) have been tested with the famous "Iron Byron" and similar robots. Putter tests using Dave Pelz's "Perfy™" were periodically published in *Golf Magazine* (i.e. July 1994 pg. 64–65; March 1995).

Pelz putter test percent distance losses for ⅜" and ¾" mishits are summarized below:

| | Odyssey Rossie II | Zebra (mallet) | Titlest Bullseye | Wilson 8802 Blade |
|---|---|---|---|---|
| ±⅜" | 5.56% | 6.85% | 9.07% | 10.56% |
| ±¾" | 18.33% | 18.89% | 31.48% | 32.41% |

The above published Pelz data indicates that putterheads with the highest moment of inertia around the center of gravity tended to have the lowest percent distance loss. Doubling the mishit distance (i.e. from ⅜ in. to ¾ in.) tripled the distance loss.

In the art, Beaumont (U.S. Pat. No. 5,529,543) and Rohrer (U.S. Pat. No. 5,766,093), the disclosures of which are both incorporated herein by reference, both claim clubhead insert devices reducing mishit distance loss via variable energy absorption (more at center than periphery). Beaumont claims improved irons using a single energy absorbing "component" or "plug" of variable thickness (thickest at club center). In some claims, the single energy absorbing plug is behind a rigidly attached thin plate of stiff or hard, but flexible, material.

Softer elastomeric striking faces are less desirable than harder polymer or metal faces for both putters and irons for durability, feel, and acoustic reasons. Beaumont anticipates some of the above limitations in his claims 9–19 by rigidly affixing "by epoxy or the like" to the rigid clubhead body, a "thin plate . . . which is stiff, or hard, but deformable upon impact . . . " over the energy absorbing void or elastomer.

Rohrer uses a plurality of energy absorbing elastomer "elements", plugs, or components with or without faceplates with the deadest elements at the center of the clubhead and elements of more lively material more remote to reduce or eliminate mishit distance loss on putters.

Others have used either a single uniform thickness insert on putters to influence total distance (increase or decrease) and for feel (vibration feedback), but not to reduce mishit distance loss. Still, others have used multiple hardness materials to influence mishit ball direction or feel, but not to reduce mishit distance loss.

SUMMARY OF THE INVENTION

The subject invention provides alternative means to correct for mishit distance loss in putters and irons using more durable, compact, and practical variable energy absorbing designs than the prior art. The undesirable "trampoline or spring face" and "incompressibility" effects of the prior art are overcome.

DESCRIPTION OF PREFERRED EMBODIMENTS

It is important to recognize that an elastomer's (or any other solid material) hardness (as typically characterized as Durometer or Elastic Modulus) is totally distinct from, and unrelated to, its energy absorbing properties (typically characterized as Bayshore Rebound % or Coefficient of Restitution). Some hard elastomers (like a squash ball) can be very dead while much softer elastomers (like multicolored urethane "superbounce" toy balls) can be extremely lively.

Putter tests conducted by Rohrer using an impact robot ("Stainless Steve" who produces repeatable identical velocity strokes) on the constructions taught and claimed in Beaumont Claims 9–19, show that when thin metal or rigid plastic flexible faceplates or coverplates are rigidly attached to part or all of a clubhead periphery, most or all of the effect of any underlying variable energy absorbing mishit distance correcting mechanisms are lost for the following reasons:

1. To be durable and practical, Beaumont's thin cover plates must be metallic or have comparable stiffness and durability properties. When a metal cover plate is "rigidly attached" or affixed around all or part of its periphery to a rigid clubhead body (defined herein as, that when there is little or no relative movement between the coverplate and clubhead body at the attachment points), then the coverplate produces a "trampoline or spring face effect" which may actually absorb less energy than a solid clubhead with on-center hits (Reference 11–98, *Golf Smith Magazine*, pgs. I-1, I-2, I-7 & I-8). If an energy absorbing (low rebound rate or viscoelastic) elastomer is placed behind a "stiff hard" rigidly affixed flexible faceplate of practical thickness, the impact with a golf ball will not produce sufficient faceplate and underlying elastomer deflection to absorb the clubhead kinetic energy required to correct for a typical mishit. For purposes herein, a flexible faceplate is defined as a cover layer of a material of equal or greater hardness than a golf ball or ball cover and of sufficient durability for practical multiple ball strikes which cover layer would deflect, but not permanently yield or deform, upon typical impact velocity of play if said cover layer were not partially or fully attached or constrained around its periphery.
2. An energy absorbing, low rebound rate, viscoelastic elastomer constrained in a cavity behind any thin and stiff, or hard faceplate, can only absorb energy if it is sufficiently deformed. Elastomers behave like incompressible fluids. Even if the rigidly affixed faceplate overcame the trampoline effect limitations described above, the elastomer's fluid-like incompressibility would require that the faceplate deflect outward at locations remote from the ball impact point to provide sufficient viscoelastic deformation for adequate energy absorption. We shall hereinafter refer to this as the elastomer "incompressibility effect." To illustrate the above effects, clubheads according to FIGS. 1 through 4 were constructed and tested using an impact robot, "Stainless Steve", which reproduces identical clubhead velocity throughout the tests. FIG. 1 (A & B view) was a solid aluminum putterhead. FIGS. 2 (A & B view) and 4 used a ⅜ in. deep high energy absorption (<10% Bayshore Rebound) elastomer of approximately 70 Durometer A hardness embedded (cast) into an aluminum clubhead cavity. In FIG. 4, a thin, hard (stainless steel) coverplate in intimate contact with (bonded to) the elastomer was rigidly attached (epoxied) to the clubhead body (a softer acetel plastic coverplate was similarly attached and tested). In FIG. 3, the same two coverplates (0.060 in. acetel and 0.060 stainless steel) were again epoxied to the clubhead with the viscoelastic inserts removed.

The FIG. 2 insert showed a 30% distance loss (versus the FIG. 1 solid aluminum clubhead) when struck before the clubhead center of gravity and 50% loss with ±¾ in. mishits (laterally). FIG. 3 showed no distance loss versus FIG. 1 with either the stainless steel or acetel cover plates illustrating the "trampoline effect" discussed above. FIG. 4 showed no distance loss with the stainless cover plate (due to both the trampoline and incompressibility effects previously discussed). With the acetel cover plate, FIG. 4 distance loss was reduced to about half the FIG. 1 values. Thus, even with a relatively elastic acetel faceplate, not durable enough for practical iron play, and a very deep (0.375 in.) insert of extremely dead material (<10% Bayshore Rebound) we could only get about half of the center of clubface energy absorption required for full mishit distance correction.

It is highly desirable in clubhead design to make mishit distance correctly energy absorbing inserts for both irons and putters as thin or compact, and therefore efficient, as possible thus, allowing them to be incorporated into existing popular clubhead designs without making such clubheads appear fat or bulky. The subject invention allows greater clubface deflection and thus, greater elastomer deformation and energy absorption thus, allowing energy absorbing inserts to be more efficient and compact.

Advantages of the subject invention will be understood and appreciated by reference to the following drawings and descriptions, which are not to scale for irons or putters and exaggerate some features for clarity.

FIGS. 1–4 were previously discussed and illustrate practical and performance deficiencies in the prior art. FIG. 5 illustrates how a protective faceplate or coverplate (1) can be flexibly attached (defined herein as, allowing relative movement upon ball impact between the faceplate periphery and the adjacent rigid clubhead body) over an energy absorbing elastomer insert (3) embedded into a rigid clubhead body (2) to avoid or diminish any "trampoline or incompressibility effects." The protective faceplate (1) can be as hard and durable as necessary. Nylon, acetel, or other plastic faceplates are durable enough for putters. Metal, reinforced composites, or metal faced reinforced composites, are suitable for irons or woods. The faceplate (1) is not rigidly attached to the rigid clubhead body (2), but is in intimate contact (bonded) with the viscoelastic insert (3). The flexible attachment is accomplished by allowing a sufficient thickness of elastomeric material behind all portions of the faceplate such that the faceplate periphery can move relative to the rigid clubhead body upon ball impact and faceplate deflection. Rigid clubhead bodies, for purposes herein, are defined as putter or iron clubhead sections (excluding integral or attached striking faceplates or inserts) of metal or polymer, cast, molded, or machined, which exhibit little or no deflection or deformation upon ball impact. FIG. 6 shows a minor alternative to FIG. 5 where the periphery of the faceplate (4) is in contact with the clubhead (2), but not adhered to it by either the viscoelastic (3) or any other more rigid means again leaving the periphery unconstrained to move upon faceplate impact and deflection.

In FIG. 7, the faceplate (1) is connected to the clubhead (2) by one or more viscoelastic elements (3) with an opening (5) or void (not shown) behind the center of the clubhead ("intended strikepoint"). In this arrangement, upon ball impact and faceplate deflection, one or more viscoelastic elements absorb energy primarily via shear deformation (and to a lesser degree by compressive deformation). The faceplate deflects rearward while moving laterally at its periphery upon impact with the ball.

In FIG. 8, the protective faceplate (1) is connected to the rigid clubhead (2) by one or more viscoelastic elements (3) so arranged that the elements absorb energy via both shear and tension as the faceplate deflects rearward upon impact while moving laterally at its periphery.

FIG. 9 (A & B view) partially overcomes the trampoline and incompressibility effects previously described by milling or casting multiple slots (6) into a faceplate, which is rigidly attached to the clubhead (2) or an integral part thereof. The slots may coincide with the horizontal "grooves" common to most irons. The horizontal slots (6) free trampoline type periphery constraints in the vertical direction and create multiple lateral face bars (7) such that only a portion of the face bars, normally contact the ball upon impact, thereby increasing faceplate deflection and energy absorption by the viscoelastic insert(s) (3) behind said bars (7).

FIG. 10 (A & B view), like FIG. 9, employs lateral slots (6) through the faceplate (1) and one or more lateral face bars (7) rigidly attached to the clubhead (2) or integral to the rigid clubhead body material. The flexibility of the face bars is further enhanced by at least one vertical slot (8) through the face bars (7).

FIG. 11 is a frontal view of multiple faceplate striking elements (9) to enhance faceplate flexibility in intimate contact with, and substantially covering, one or more energy absorbing elastomer elements. Such faceplate striking elements may be rigid or flexible, metal or plastic and hexagonal (shown), square, rectangular, or any other shape.

FIG. 12 addresses the fluidic incompressibility problems of energy absorbing elastomer inserts, especially those constrained in a clubhead cavity (3) and covered with a hard protective faceplate (1). The single or multiple elastomer elements are segmented with multiple vertical and/or horizontal slots (10), or numerous small boreholes, or a waffle pattern creating multiple voids such that compression of the insert upon ball impact produces localized lateral deformation of the elastomer into the slots, holes, or other multiple voids (10).

FIG. 13 (A & B view) also addresses the fluidic incompressibility constraints on energy absorbing elastomer deformation and energy absorption efficiency previously discussed. Rather than fully surrounding the elastomer insert by the rigid clubhead body, the top and/or bottom of the insert cavity remains open or not in intimate contact with the elastomer via a void thus, allowing the elastomer upon impact with a golf ball to deform upward and/or downward thus, increasing elastomer deformation and energy absorption.

In FIG. 14, the cavity (13) in intimate contact with the less energy absorbing elastomer(s) (11), and the more energy absorbing elastomer (3), is shaped to allow more angular deflection at points progressively remote from the intended strikepoint thus, at least partially correcting misdirection caused by mishits. The center more energy absorbing element (3) is thickest behind the strikepoint for maximum energy absorption at the center and progressively less at points more remote for mishit distance correction.

FIG. 15 utilizes fluidic (gas or liquid) throttling (multiple shock absorbers) for energy absorption. A flexible faceplate (1) is either flexibly attached to a rigid clubhead via one or more elastomeric elements (14) or alternatively rigidly attached to the clubhead. Multiple small pistons (15) are attached to either the faceplate (1), as shown, or the clubhead body, or molded integral with it. The piston nearest the clubcenter strikepoint (16), has means for absorbing more energy via either a longer piston stroke, a larger piston diameter, and/or a larger throttling orifice (17). If a fluid is used rather than air, the throttling orifices (17) upon ball impact would exhaust into a fluid reservoir (not shown).

The above invention is useful in putters where ball impact velocity is generally insufficient to allow enough rigidly attached faceplate deflection and energy absorbing elastomer element deformation to get substantial or full mishit distance correction. The invention is also useful in irons where the faceplate must be hard and durable enough for useful playing life while the absorbing element(s) must be thin enough for popular iron designs.

Various embodiments of the present invention have been described above and illustrated in the figures. The figures are not necessarily to scale and in many cases, enlarge the features being described. All features of the invention can be incorporated into putters, iron and wood clubheads, which can retain current traditional external shape and appearance. Described or claimed features of the invention can be used in combination with other features or claims. While most of the distance and directional corrective features are described and claimed for lateral (horizontal) mishits, the same features and claims can also correct vertical mishits, although vertical mishits produce substantially less distance loss and misdirection than lateral mishits of equal distance from the clubface strikepoint.

The present invention is not limited to the embodiments shown, as many variations will be evident to one skilled in the art, which variations are intended to be encompassed in the present invention as set forth in the following claims.

What is claimed is:

1. A golf putter or iron clubhead with a flexible faceplate of equal or greater hardness than a golf ball or golf ball cover flexibly attached to a rigid clubhead body and in intimate contact with one or more energy absorbing elastomer elements, the highest energy absorbing elastomer element being thickest behind the clubface intended strikepoint for maximum energy absorption at this point and thinner at points incremently remote from said strikepoint, thus at least partially correcting for distance loss due to mishits.

2. A golf clubhead according to claim 1, where at least a portion of the periphery of the faceplate backside is in intimate contact with, or bonded to, one or more of the energy absorbing elastomer elements, and in sliding contact with the rigid clubhead body.

3. A golf putter or iron clubhead with a flexible faceplate of equal or greater hardness than a golf ball or golf ball cover flexibly attached to a rigid clubhead body by one or more energy absorbing elastomer elements located at the periphery of said faceplate, said elements also being attached to the rigid clubhead body leaving a void, cavity, or opening generally behind the strikepoint area between the faceplate and clubhead body, such flexible faceplate and energy absorbing elastomer elements being so arranged that maximum faceplate deflection and elastomer shear and compression deformation and therefore maximum energy absorption occurs when the faceplate is struck at the intended strikepoint and incrementally less energy is absorbed at points incrementally remote from said intended strikepoint thus at least partially correcting for mishit distance loss.

4. A golf putter or iron clubhead with a flexible faceplate of equal or greater hardness than a golf ball or golf ball cover flexibly attached to a rigid clubhead body via one or more energy absorbing elastomer elements located at the periphery of said faceplate, said elements also being attached to the rigid clubhead body leaving a void, cavity, or opening generally behind the strikepoint between the faceplate and clubhead body, such flexible faceplate and energy absorbing elastomer elements being so arranged that maximum faceplate deflection and elastomer shear and tensile deformation and therefore maximum energy absorption occurs when the faceplate is struck at the intended strikepoint and incrementally less energy is absorbed at points incrementally remote from said intended strikepoint thus at least partially correcting for mishit distance loss.

5. A golf putter or iron clubhead with a flexible faceplate of equal or greater hardness than a golf ball or golf ball cover rigidly attached around part or all its periphery to a rigid clubhead body or an integral part of said clubhead body material such faceplate having one or more cast or machined horizontal or longitudinal through slots, which may coincide with traditional clubface grooves, to improve faceplate flexibility while preserving faceplate thickness and durability, such clubhead having one or more energy absorbing elastomer elements between, and in intimate contact with, said faceplate and said rigid clubhead body, the highest energy absorbing elastomer element being thickest behind the clubface intended strikepoint, thus at least partially correcting for distance loss due to mishits.

6. A golf putter or iron clubhead of claim 5 such faceplate also having one or more cast or machined vertical through slots to further improve faceplate flexibility while preserving faceplate thickness and durability, such clubhead having one or more energy absorbing elastomer elements between said faceplate and said rigid clubhead body, the highest energy absorbing elastomer being thickest behind the clubface intended strikepoint, thus at least partially correcting for distance loss due to mishits.

7. A golf putter or iron clubhead with a flexible faceplate of equal or greater hardness than a golf ball or ball cover comprised of a plurality of rigid or flexible faceplate striking elements in intimate contact with one or more energy absorbing elastomer elements, the highest energy absorbing elastomer being thickest behind the clubface intended strikepoint, thus at least partially correcting for distance loss due to mishits.

8. A golf putter or iron clubhead with or without a flexibly or rigidly attached, or integral faceplate of equal or greater hardness than a golf ball or ball cover in front of and in intimate contact with one or more energy absorbing elastomer elements, the highest energy absorbing elastomer element being thickest behind the clubface intended strikepoint and thinner at points incrementally remote from said strikepoint, such energy absorbing elastomers having multiple holes, slots, or voids, to enhance element compressibility and deformation upon ball impact and hence energy absorbing properties.

9. A golf putter or iron clubhead with a flexibly or rigidly attached, or integral faceplate of equal or greater hardness than a golf ball or ball cover in front of, and in intimate contact with, one or more energy absorbing elastomer elements, at least a major portion of the top or bottom of such elements not being in contact with the rigid clubhead body insert cavity thus, enhancing element deformation and energy absorption, the highest energy absorbing elastomer element being thickest behind the clubface intended strikepoint thus, at least partially correcting for distance loss due to mishits.

10. A golf putter or iron clubhead with a flexible faceplate of equal or greater hardness than a golf ball or golf ball cover rigidly or flexibly attached to a rigid clubhead body said faceplate having one or more small pneumatic or hydraulic pistons and cylinders between the faceplate and clubhead body, or integral thereto, such pistons being positioned into cylinders with throttling vent holes molded or machined in such a manner that maximum deflection and throttling energy absorption occurs at the intended strikepoint and incrementally less faceplate deflection and energy absorption occurs at points incrementally remote from the intended strikepoint thus at least partially correcting for mishit distance loss.

* * * * *

UNITED STATES PATENT AND TRADEMARK OFFICE

CERTIFICATE OF CORRECTION

PATENT NO. : 6,431,997 B1 
DATED : August 13, 2002
INVENTOR(S) : Rohrer

It is certified that error appears in the above-identified patent and that said Letters Patent is hereby corrected as shown below:

Please insert the BRIEF DESCRIPTION of the drawings as shown on the attached sheet.

Signed and Sealed this

Seventeenth Day of December, 2002

JAMES E. ROGAN
*Director of the United States Patent and Trademark Office*

Figure 1A:
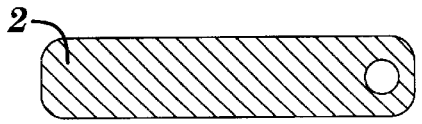
FIG. 1A PRIOR ART
Figs. 1A and 1B are plan sections and elevations, respectively, of a prior art conventional solid metal putterhead.
Figure 2A:
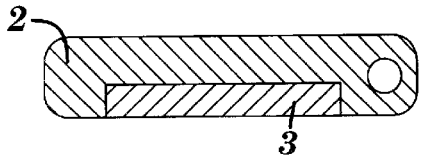
FIG. 2A PRIOR ART
Figs. 2A and 2B are plan sections and elevations, respectively, of a prior art clubhead or putterhead with recessed elastomeric energy absorbing insert.
Figure 1B:
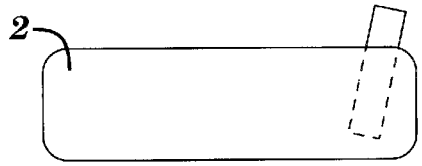
FIG. 1B PRIOR ART
Figure 2B:
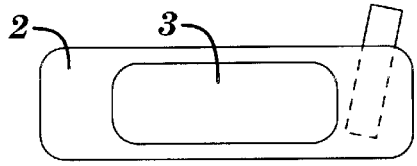
FIG. 2B PRIOR ART
Figure 3:
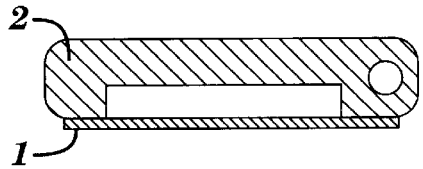
FIG. 3 PRIOR ART
Fig. 3 is a plan section of a prior art clubhead or putterhead with a stiff, but flexible, faceplate rigidly attached over an empty cavity.
Figure 4:
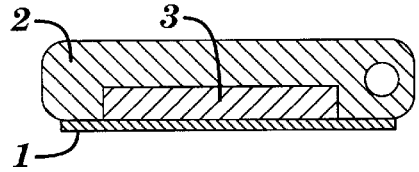
FIG. 4 PRIOR ART
Fig. 4 is a plan section of a prior art clubhead or putterhead with a stiff, but flexible, faceplate rigidly attached over an energy absorbing elastomer filled cavity.
Figure 5:
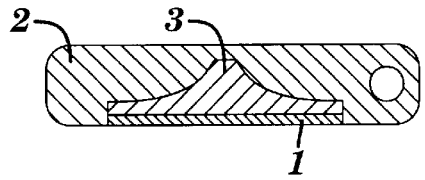
Fig. 5 is a plan section of an embodiment the present invention with a recessed flexible faceplate.
Figure 6:
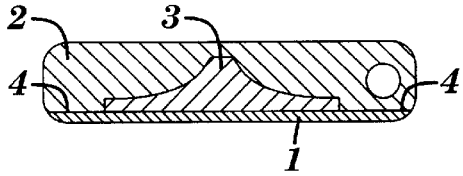
Fig. 6 is a plan section of an embodiment of the invention with a flexible faceplate.
Figure 7:
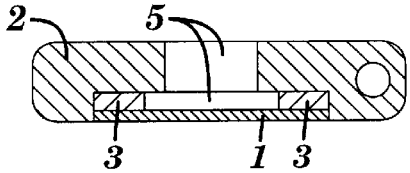
Fig. 7 is a plan section of an embodiment of the invention having an elastomer which deforms under shear and compression.
Figure 8:
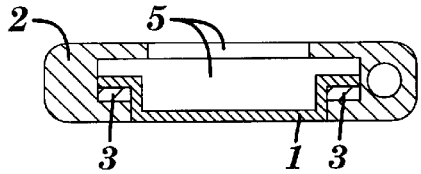
Fig. 8 is a plan section of an alternative embodiment of the present invention having an elastomer deforms under shear and tension.
Figure 9A:
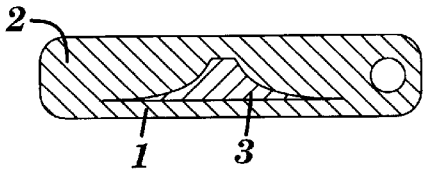
Figs. 9A and 9B are plan sections and elevations, respectively, of clubheads or putterheads of the present invention wherein an integral or rigidly attached faceplate, covering an energy absorbing elastomer element, has multiple lateral slots.
Figure 10A:
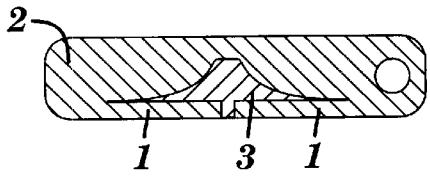
Figs. 10A and 10B are plan sections and elevations, respectively, of clubheads or putterheads of the present invention where an integral or rigidly attached faceplate, covering an energy absorbing elastomer element, has multiple lateral slots and one central vertical slot.
Figure 9B:
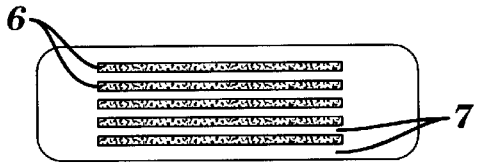
Figure 10B:
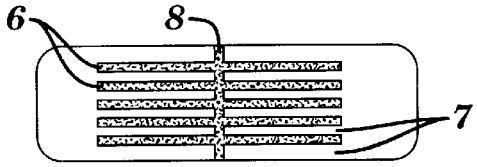
Figure 11:
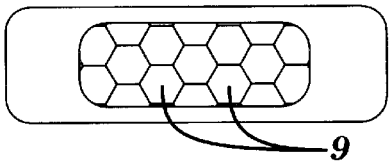
Fig. 11 is an elevation view of a clubhead or putterhead of the present invention with multiple faceplate elements attached to one or more recessed energy absorbing elastomer elements.
Figure 12:
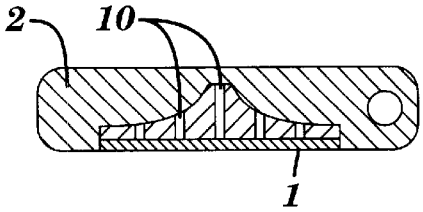
Fig. 12 is a plan section of an embodiment of the present invention with a recessed flexible faceplate attached to one or more energy absorbing elastomer elements within a clubhead or putterhead having slots or boreholes.
Figure 13A:
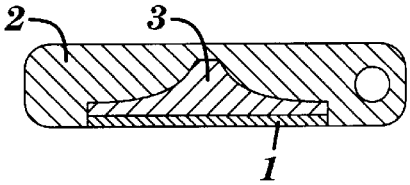
Fig. 13A and 13B are plan sections and elevations, respectively, of an embodiment of the present invention.
Figure 14:
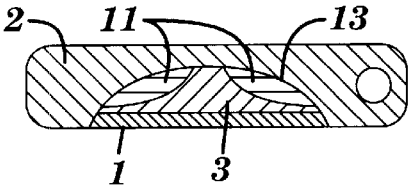
Fig. 14 is a plan section of an embodiment of the present invention with a recessed flexible faceplate attached to multiple element energy absorbing elastomers in a concave cavity.
Figure 13B:
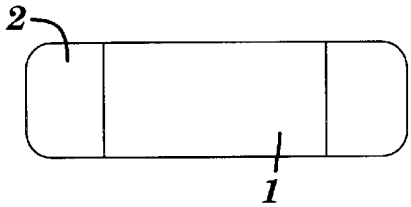
Figure 15:
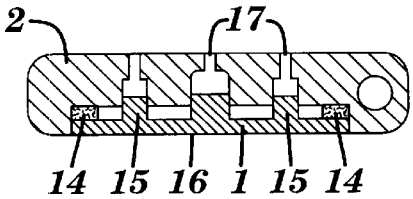
Fig. 15 is a plan section of an embodiment of the present invention having a faceplate containing multiple pistons.